United States Patent [19]

Litjens et al.

[11] Patent Number: 4,781,632

[45] Date of Patent: Nov. 1, 1988

[54] ANTI-VENTILATION PLATE

[75] Inventors: John J. Litjens, Oshkosh; Michael E. Frazzell, Neenah; Michael A. Karls, Hilbert; Ronald M. Steiner; William P. Lang, both of Oshkosh, all of Wis.

[73] Assignee: Brunswick Corporation, Skokie, Ill.

[21] Appl. No.: 106,148

[22] Filed: Oct. 8, 1987

[51] Int. Cl.[4] ..... B63H 1/18

[52] U.S. Cl. ..... 440/66; 114/145 A; 114/286; 440/78

[58] Field of Search ..... 114/285, 286, 287, 126, 114/145 R, 145 A, 152; 440/66, 78

[56] References Cited

U.S. PATENT DOCUMENTS

| | | | |
|---|---|---|---|
| 2,564,903 | 8/1951 | Irgens . | |
| 2,787,974 | 4/1957 | Johnson | 114/145 A |
| 2,912,955 | 11/1959 | Leipert | 440/66 |
| 3,628,485 | 12/1971 | Gill | 114/285 |
| 3,980,035 | 9/1976 | Johansson | 440/66 |
| 4,026,231 | 5/1977 | Ferdoko | 114/145 A |
| 4,295,834 | 10/1981 | Buzzi et al. | 440/76 |
| 4,708,672 | 11/1987 | Bentz et al. | 440/78 |

FOREIGN PATENT DOCUMENTS

| | | | |
|---|---|---|---|
| 716879 | 10/1954 | United Kingdom | 440/66 |

OTHER PUBLICATIONS

Doel Fin Hydrofoil, "The Western Boatman", Jan.-/Feb. 1986, p. 87.

Doel Fin Hydrofoil, "The Western Boatman", May/-Jun./ 1987, p. 72.

*Primary Examiner*—Sherman D. Basinger
*Assistant Examiner*—Thomas J. Brahan
*Attorney, Agent, or Firm*—Andrus, Sceales, Starke & Sawall

[57] ABSTRACT

A marine drive (2) is provided with an anti-ventilation plate (22) having a forward horizontal portion (24) and an aft portion (26) extending downwardly at an angle (28) to horizontal and noncoplanar with the forward portion (24). An adjustable anti-ventilation plate (30, 58) is also provided. The preferred form of the adjustable anti-ventilation plate is particularly simple and readily added to existing structure.

11 Claims, 1 Drawing Sheet

ANTI-VENTILATION PLATE

BACKGROUND AND SUMMARY

The present invention relates to anti-ventilation plates, sometimes called anti-cavitation plates, in marine drives. The purpose of an anti-ventilation plate is to minimize the entrance of air to a submerged propeller therebelow.

The holding ability of a propeller is improved by maintaining the propeller submerged and by preventing the entrance of surface air to the propeller. Previous attempts to improve the holding ability of the propeller and to prevent the propeller from "breaking loose" have focused on propeller design, size of the anti-ventilation plate, or the gearcase shape below the water. It is desired to keep the aft end of the anti-ventilation plate in the water or at the surface when the boat is on plane and the engine is properly trimmed out. Prior attempts to achieve this relationship involved power trim systems or vertical adjustment mechanisms, but these significantly affect overall boat trim.

Boat acceleration is influenced by many factors, including boat design, propeller and engine trim position. If the propeller and engine trim position are optimum, and the boat still accelerates poorly, it is known in the art to provide trim tabs at the transom of the boat. The trim tabs act as a lever to help push the bow of the boat down resulting in a flatter running attitude, and increasing boat speed. The majority of engine installations dictate that the anti-ventilation plate be mounted about level with the boat bottom. For best acceleration, the engine is trimmed all the way in, i.e. under. In this position, the engine's thrust is working to push the transom of the boat up and the bow of the boat down. Once the boat starts to move, the anti-ventilation plate acts as a trim tab, or lever, helping to achieve the on-plane condition.

The present invention provides an improved anti-ventilation plate preventing the entrance of air to the propeller when the boat is on plane and trimmed out, and also providing improved acceleration performance.

DETAILED DESCRIPTION

Figure 1:
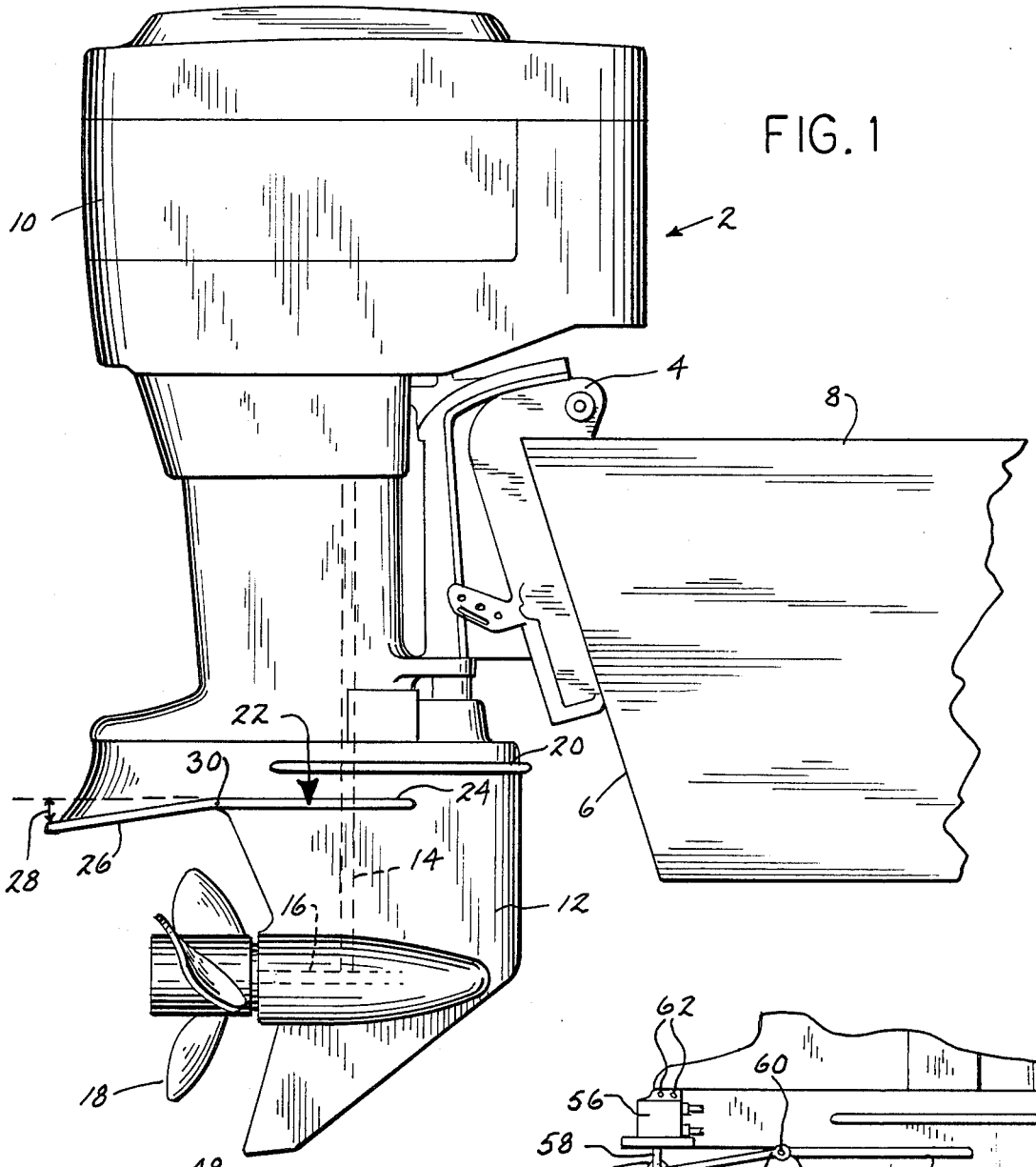
FIG. 1 shows a marine drive with an anti-ventilation plate in accordance with the invention.

FIG. 1 shows a marine drive 2 mounted by bracket 4 to the transom 6 of a boat 8. The marine drive includes a power head 10 having a lower gearcase housing 12 with a generally vertical drive shaft 14, shown in dashed line, driving a generally horizontal propeller shaft 16, shown in dashed line, having a propeller 18 mounted thereto. Lower housing 12 has an integrally formed splash plate 20 and an integrally formed anti-ventilation plate 22.

Anti-ventilation plate 22 has a forward portion 24 extending horizontally. Anti-ventilation plate 22 has an aft portion 26 extending downwardly and rearwardly from forward portion 24 and forming an angle 28 with forward portion 24 such that the forward and aft portions 24 and 26 are not coplanar. The downward extension of aft portion 26 and the noncoplanarity with forward portion 24 keep aft portion 26 submerged or at the water surface even when the boat is trimmed out. This eliminates an avenue for the entrance of air which would otherwise alter water pressure distribution around propeller 18 therebelow. This in turn minimizes the above noted undesirable breaking loose of the propeller.

Forward and aft portions 24 and 26 of anti-ventilation plate 22 meet at a junction forming a line 30 extending out of the page in FIG. 1. Line 30 is perpendicular to driveshaft 14 and is perpendicular to propeller shaft 16. The junction of forward and aft portions 24 and 26 at line 30 is above propeller 18. It has been found desirable to provide forward and aft portions 24 and 26 at an angle, rather than extending the entire anti-ventilation plate 22 downwardly. Forward portion 24 provides the anti-ventilation function prior to trimming out. Aft portion 26 provides the anti-ventilation function after trimming out. If the entire anti-ventilation plate 22 were horizontal and coplanar with forward portion 24, then the anti-ventilation function might be lost or diminished when the boat is trimmed out or under heavy acceleration if the aft end of the anti-ventilation plate rises above the water surface. If the entire anti-ventilation plate 22 were downwardly sloped, i.e. coplanar with aft portion 26, then air entrance and ventilation may occur at lower engine speeds and light acceleration if the forward portion of the anti-ventilation plate is above the water surface. The noncoplanar forward and aft portions 24 and 26 are thus considered desirable aspects of the invention.

Figure 2:
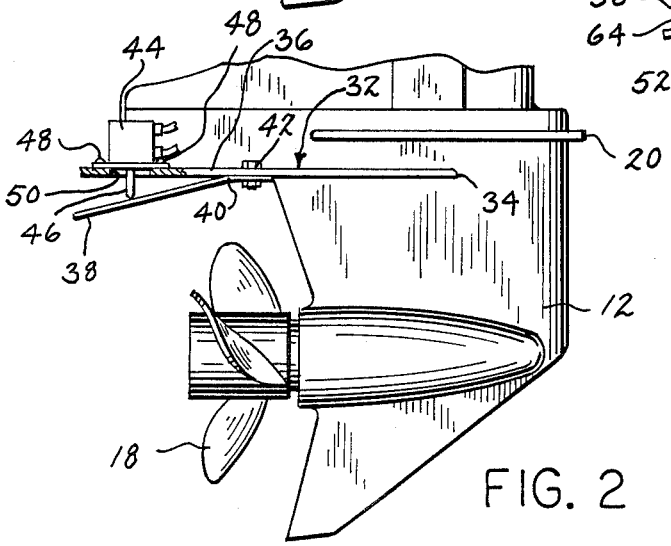
FIG. 2 shows a portion of FIG. 1 with an alternate embodiment.

FIG. 2 shows an alternate embodiment of the structure in FIG. 1, and uses like reference numerals where appropriate to facilitate clarity. Lower gearcase housing 12 has a fixed integral horizontal anti-ventilation plate 32 having a horizontal forward portion 34 and a horizontal aft portion 36 extending coplanarly rearwardly from forward portion 34 and over propeller 18. A second anti-ventilation plate 38 is mounted to the housing and extends rearwardly and downwardly at an angle relative to horizontal. Anti-ventilation plate 38 is a semi-rigid sheet-like member and has a forward end 40 fixedly mounted to the underside of plate 32 on housing 12 by right and left bolts, one of which is shown at 42. Plate 38 extends rearwardly beneath aft portion 36 of plate 32 and above propeller 18. Adjustment means are provided by a fluid cylinder 44, preferably a hydraulic cylinder, or alternatively an air cylinder, having a plunger actuator 46 for moving the aft end of plate 38 up and down to adjustably change the angle of plate 38 relative to horizontal. Fluid cylinder 44 is mounted to aft portion 36 of plate 32 by bolts 48. Aft portion 36 has an opening 50 therethrough. Plunger 46 extends through opening 50 to engage plate 38 and deflect and flex plate 38 to change its angle relative to horizontal.

Figure 3:
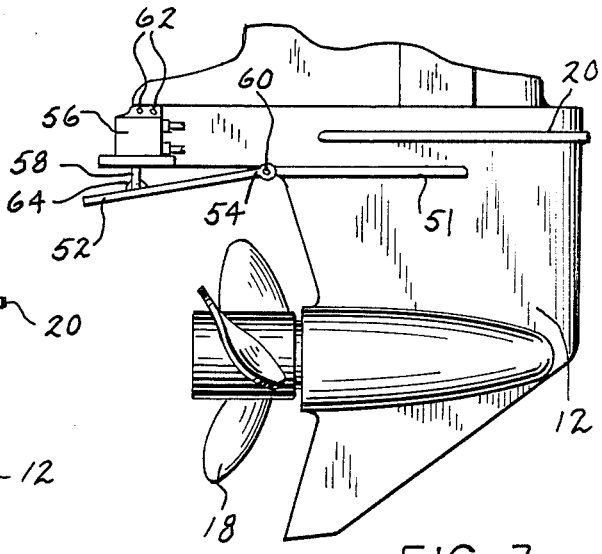
FIG. 3 shows a portion of FIG. 1 with another alternate embodiment.

FIG. 3 shows another alternate embodiment, and like reference numerals are used from FIGS. 1 and 2 where appropriate to facilitate clarity. FIG. 3 shows a forward fixed horizontal anti-ventilation plate 51 on the lower gearcase housing. FIG. 3 also shows an adjustable anti-ventilation plate 52 above propeller 18 and having a forward end 54 mounted to housing 12 and having an aft end moveable up and down as adjusted by fluid cylinder 56 having actuator plunger 58. The aft end of anti-ventilation plate 52 is moved up and down to adjustably change the angle of plate 52 relative to horizontal. Plate 52 is a rigid sheet-like member having its forward end 54 pivotally mounted to housing 12 at hinge pin 60, which pin extends along a line perpendicular to driveshaft 14 and perpendicular to propeller shaft 16. Fluid cylinder 56 is mounted to housing 12 by bolts 62, and plunger 58 is connected to plate 52 by link 64 to pivot plate 52 about forward end 54 at hinge pin 60 to change the angle of plate 52 relative to horizontal.

It is recognized that various equivalents, alternatives and modifications are possible within the scope of the appended claims.

We claim:

1. A marine drive comprising a lower housing spaced rearwardly of the transom of a boat and defining an air space therebetween and having a generally vertical drive shaft driving an generally horizontal propeller shaft having a propeller mounted thereto, and an anti-ventilation plate on said housing, said anti-ventilation plate having a forward portion extending horizontally and an aft portion extending downwardly and rearwardly from said forward portion and forming an angle with the said forward portion such that said forward and aft portions are not coplanar, said forward and aft portions meeting at a junction spaced above and forward of the outermost tips of the blades of the propeller and along a smooth continuous unbroken line to prevent entry of air beneath said plate.

2. A marine drive comprising a lower housing spaced rearwardly of the transom of a boat and defining an air space therebetween and having a generally vertical drive shaft driving a generally horizontal propeller shaft having a propeller mounted thereto, said housing including a fixed horizontal anti-ventilation plate having a horizontal forward portion on said housing and having a horizontal aft portion extending coplanarly rearwardly from said forward portion and over said propeller, and comprising a second anti-ventilation plate mounted to said housing and extending rearwardly and downwardly at an angle relative to horizontal, said second plate and said first mentioned plate meeting at a junction spaced above and forward of the outermost tips of the blades of the propeller.

3. The invention according to claim 1 wherein said second anti-ventilation plate has a forward end mounted to said housing and has an aft end, and comprising adjustment means comprising means for moving said aft end of said second plate up and down to adjustably change said angle of said second plate relative to horizontal.

4. The invention according to claim 3 wherein said forward end of said second plate is mounted to said first mentioned plate.

5. The invention according to claim 4 wherein said forward end of said second plate is mounted to the underside of said first plate and extends rearwardly beneath said aft portion of said first plate and above said propeller.

6. The invention according to claim 5 wherein said adjustment means comprises means mounted to said aft portion of said first plate and having an actuator member engaging said second plate to move said aft end of the latter to change said angle.

7. The invention according to claim 6 wherein said aft portion of said first plate has an opening therethrough, and wherein said actuator member of said adjustment means extends through said opening and engages said second plate.

8. A marine drive comprising a lower housing spaced rearwardly of the transom of a boat and defining an air space therebetween and having a generally vertical drive shaft driving a generally horizontal propeller shaft having a propeller mounted thereto, an adjustable anti-ventilation plate above said propeller and having a forward end mounted to said housing at a junction spaced above and forward of the outermost tips of the blades of the propeller and having an aft end, and adjustment means comprising means for moving said aft end of said plate up and down to adjustably change the angle of said plate relative to horizontal, wherein said forward end of said plate is mounted to said housing about a hinge line extending perpendicularly to said drive shaft and perpendicularly to said propeller shaft, and wherein said adjustment means moves said plate about said hinge line.

9. The invention according to claim 8 wherein said plate is a sheet-like member having its forward end rigidly fixed to said housing, and wherein said adjustment means engages said plate and deflects and flexes said plate to change said angle.

10. The invention according to claim 8 wherein said plate is a sheet-like member having its forward end pivotally mounted to said housing, and wherein said adjustment means engages said plate and pivots said plate about said forward end to change said angle.

11. The invention according to claim 8 wherein said adjustment means comprises fluid cylinder means mounted to said housing and having a moveable actuator member engaging said plate.

* * * * *

UNITED STATES PATENT AND TRADEMARK OFFICE

CERTIFICATE OF CORRECTION

PATENT NO. : 4,781,632

DATED : November 1, 1988

INVENTOR(S) : JOHN J. LITJENS ET AL

It is certified that error appears in the above-identified patent and that said Letters Patent is hereby corrected as shown below:

Col. 3, line 15, claim 1, delete "an" and substitute therefor -- a --; Col. 3, line 44, claim 3, delete "1" and substitute therefor -- 2 --.

Signed and Sealed this

Nineteenth Day of September, 1989

*Attest:*

*Attesting Officer*

DONALD J. QUIGG

*Commissioner of Patents and Trademarks*